United States Patent [19]

Franklin

[11] Patent Number: 4,561,550

[45] Date of Patent: Dec. 31, 1985

[54] VARIABLE MULTI-BAY DISPLAY

[75] Inventor: Robert P. Franklin, Lake Hopatcong, N.J.

[73] Assignee: Trans-World Manufacturing Corporation, East Rutherford, N.J.

[21] Appl. No.: 533,213

[22] Filed: Sep. 19, 1983

[51] Int. Cl.[4] ..... A47F 5/00

[52] U.S. Cl. ..... 211/184; 211/189; 211/175; 40/605

[58] Field of Search ..... 211/184, 189, 175, 195, 211/198, 199, 104; 40/610, 611, 605, 606, 539, 488, 491

[56] References Cited

U.S. PATENT DOCUMENTS

| | | | |
|---|---|---|---|
| 2,163,259 | 6/1939 | Moore | 40/605 X |
| 3,161,298 | 12/1964 | Naslund | 211/104 |
| 3,319,801 | 5/1967 | Nordstrom | 211/199 |
| 3,559,814 | 2/1971 | Downing | 40/605 X |
| 4,194,313 | 3/1980 | Downing | 40/606 X |
| 4,319,688 | 3/1982 | Wahl | 211/175 |
| 4,428,136 | 1/1984 | Franklin | 211/175 X |

*Primary Examiner*—Robert W. Gibson, Jr.
*Assistant Examiner*—Blair M. Johnson
*Attorney, Agent, or Firm*—Ostrolenk, Faber, Gerb & Soffen

[57] ABSTRACT

A kit for making a multi-bay display is disclosed. The kit includes a continuous rear wall, a plurality of bay dividers and means for attaching the bay dividers to the rear wall to form a multi-bay display. Each of the bay dividers includes first and second panels hingedly connected to one another, at least one extension member and means for coupling the extension member to a respective panel in a manner which permits the effective length of the panels to be adjusted.

12 Claims, 5 Drawing Figures

VARIABLE MULTI-BAY DISPLAY

BACKGROUND OF THE INVENTION

A primary object of the present invention is the utilization of a pegboard display device where, instead of a single continuous wall which may present a cluttered appearance, a plurality of bays or recesses are created so that the goods which are displayed may be set off from each other and grouped in appropriate groupings. A separation into individual bays provides a separation of types of merchandise while nevertheless leaving the entire display open to view and provides for a more pleasing arrangement of the merchandise in each particular bay so that it will be more readily acceptable and available to the consumer.

In co-pending application Ser. No. 353,488, filed Mar. 1, 1982, this object is achieved by using a plurality of hinged dividers which cooperate with a continuous rear wall of the display to form triangular dividers which separate the display into individual bays. Three types of dividers are required: a right end divider, a left end divider and one or more center dividers. As seen in FIG. 1, the right and left end dividers form right triangles with the rear wall of the display while the center divider forms an isosceles triangle therewith. As a result, it was previously necessary to manufacture three different types of dividers. This increased the manufacturing costs and decreased the flexibility of the system since a right end divider could only be used as a right end divider, a left end divider could only be used as a left end divider, and a center divider could only be used as a center divider.

BRIEF DESCRIPTION OF THE PRESENT INVENTION

The primary object of the present invention is to overcome the foregoing drawbacks by providing a universal divider which can be used as a left end divider, a center divider or a right end divider.

A further object of the present invention is to provide a multi-bay display which is adjustable in both the number of bays and the size of respective bays.

Yet a further object of the present invention is the provision of a multi-bay display which includes headers which blend into a main header so as to provide the appearance of a continuous, custom-made display.

A corollary object of the present invention is the provision of panels for a display device to create bays along a display in which merchandise may be segregated or displayed in related form wherein the bays may have different vertical wall arrangements spaced from each other by an amount desired by the creator of the display.

These and further objects of the present invention are achieved by providing a kit for making a multi-bay display, the kit including:

(A) a continuous rear wall;

(B) a plurality of bay dividers, each said bay divider including:

(1) first and second panels hingedly connected to one another;

(2) at least one extension member; and (3) means for coupling each said extension member to a respective said panel in a manner which permits the effective length of said panels to be adjusted; and (C) means for catching said bay dividers to said rear wall to form a multi-bay display.

DETAILED DESCRIPTION OF THE INVENTION

Figure 1:
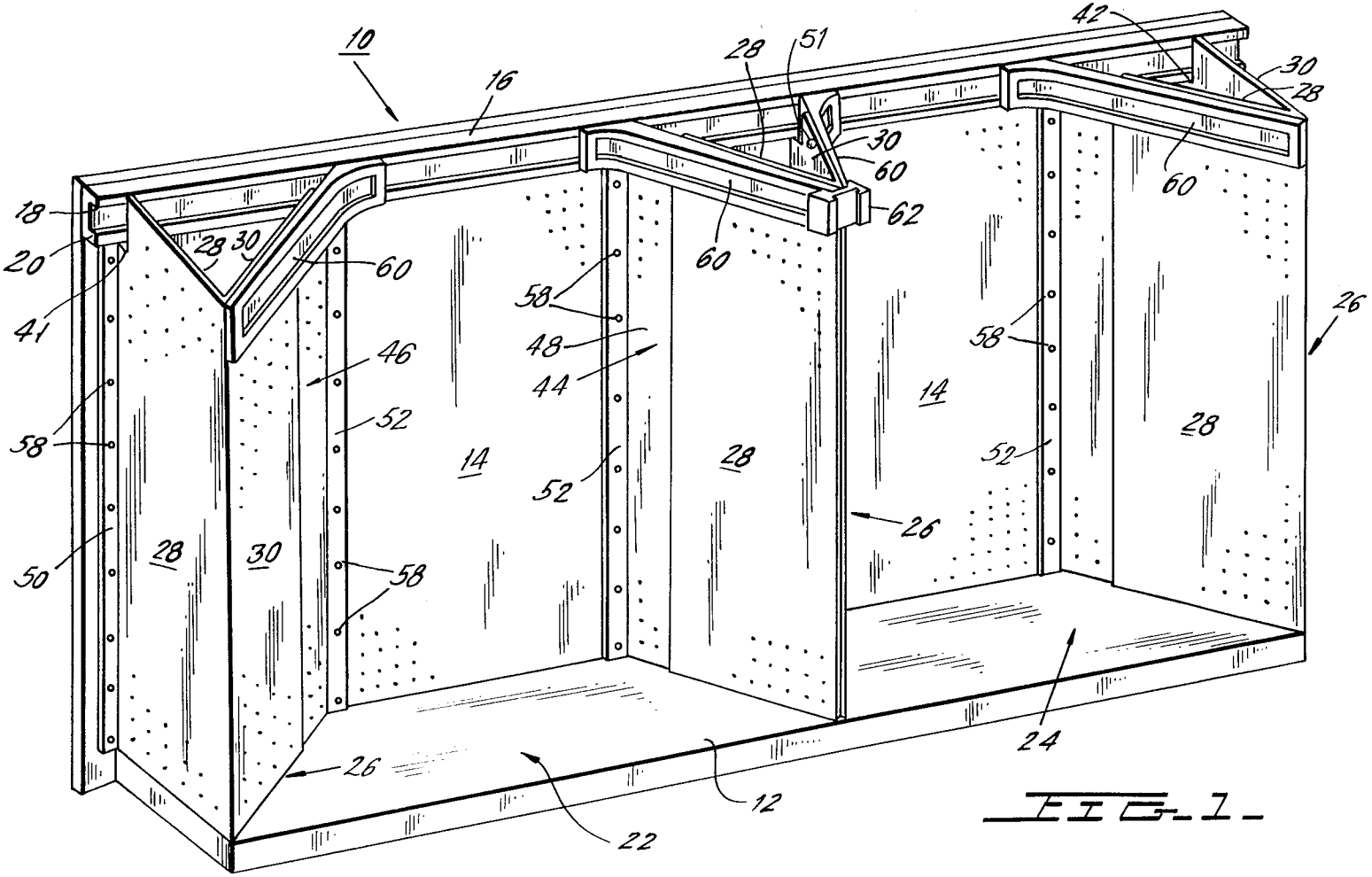
FIG. 1 is a perspective view showing a multi-bay display formed using the kit of the present invention.

Referring now to the drawings wherein like numerals indicate like elements, there is shown in FIG. 1 a multi-bay display constructed using the kit of the present invention and designated generally as 10. Display 10 includes a base member 12 to which a rear wall 14 is connected by appropriate means. The rear wall 14 is preferably formed of a an operture board material to which display hangers can be hung. The rear wall 14 is preferably a singular continuous wall which extends the entire width of the display. A principal header 16 extends substantially the entire width of the rear wall 14 and includes a pair of slots 18, 20 which can hold advertising material or a decorative pattern. The display 10 is divided into a plurality of bays 22, 24 by a plurality of dividers 26. While two bays are shown, the display can be divided into a large plurality of bays by merely increasing the length of the rear wall and by providing additional central dividers 26.

Figure 2:
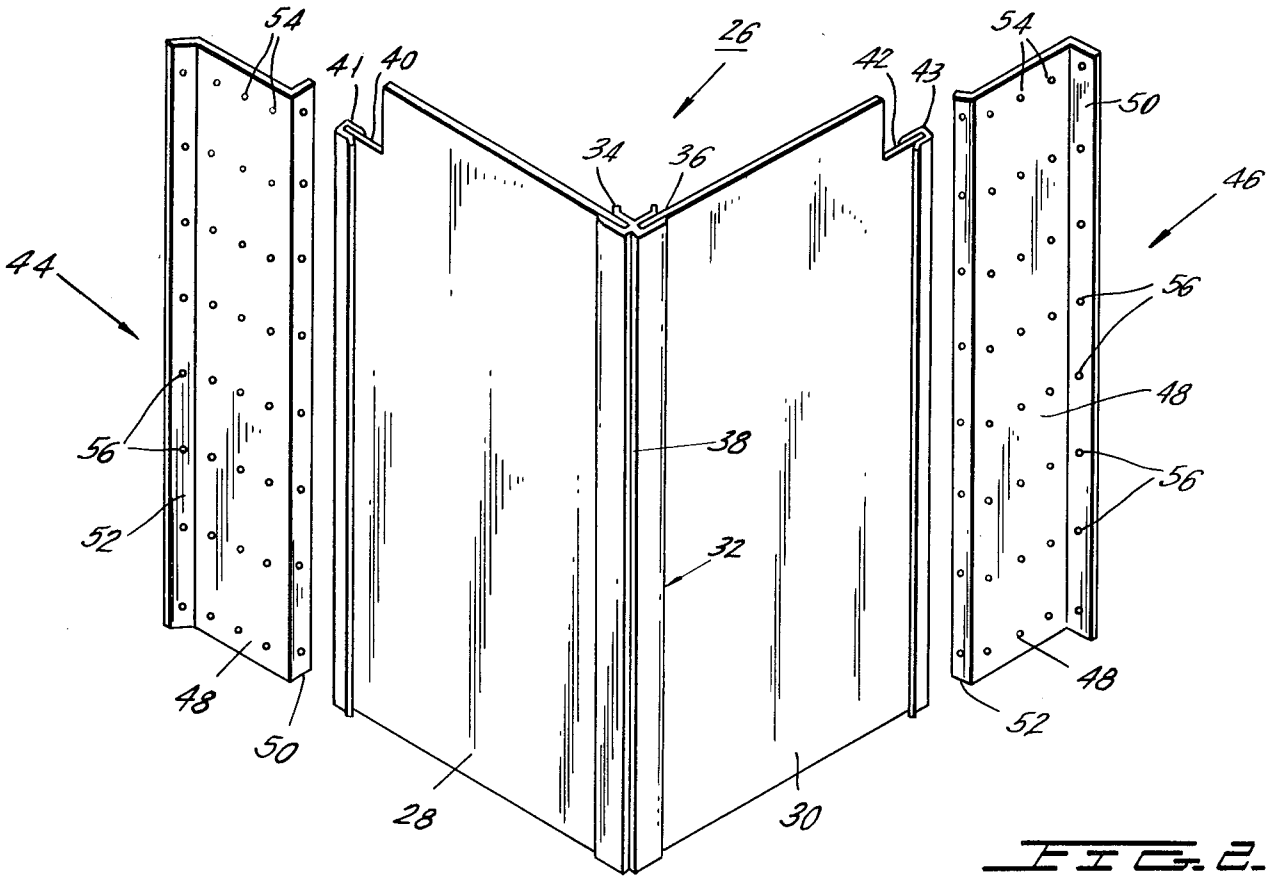
FIG. 2 is a perspective view of the divider of FIG. 1 in the unassembled condition.

The dividers 26 preferably take the form illustrated in FIG. 2. As shown therein, each divider 26 includes a pair of divider walls 28, 30 (these walls are preferably formed of an operture board material similar to the rear wall 14) which are hinged together preferably by a "living" hinge 32. The hinge 32 is preferably formed from a unitary molded or extruded plastic material which includes a pair of channels 34, 36 which receive the walls 28, 30, respectively, and which are hinged together along a score line 38. The walls 28, 30 are glued or otherwise attached to the channels 34, 36 of the hinge 32. Finishing members 41 may be added to the exposed ends of walls 28, 30 if desired.

The upper left-hand corner of the wall 28 includes a notch 40 which is equal in height and depth to the height and depth of the prinicpal header 16. A similar notch 42 is formed in the upper right-hand corner of the wall 30.

A pair of extension members 44, 46 are also provided. The extension members 44 each include a planar extension section 48, a right angle section 50 and an oblique angle section 52. The height of the extension members 44, 46 is equal to the height of the walls 28, 30 measured from the bottom of the walls to the bottom of the notches 40, 42 as viewed in FIG. 2. A plurality of holes 54 are preferably provided in the extension section 48 of the members 44, 46 to enable the extension members to be selectively connected to respective walls 28, 30 in either of two orientations described below. This connection could be made using bolts, rivets, or any other appropriate securing means (shown schematically as 61 in FIG. 3). A plurality of holes 56 are also formed in the sections 50, 52 so as to enable either the section 5:0 or the section 52 to be connected to the rear wall 14 (depending upon the orientation of the extension member) using blts, rivets or any other appropriate securing means.

As will be shown below, each of the walls 28, 30 can be oriented either perpendicular to the rear wall 14 or at an acute angle with respect thereto. When the wall 28, 30 is to be connected to the rear wall 14 at a right angle, the associated extension member 44, 46 is connected to its respective wall with the orientation illustrated with respect to extension member 46 in FIG. 2. When a given wall 28, 30 is to be connected to the rear wall at an oblique angle, the extension member is connected to the respective wall 28, 30 with the orientation illustrated with respect to extension member 44 in FIG. 2. The angle that the oblique angle section 52 forms with the extension section 48 will also define the angle in which the respective wall 28, 30 will form with the rear wall 14.

As a result of the foregoing, the divider 26 illustrated in FIG. 2 can be used as a left-hand divider, a right-hand divider or a central divider by merely reorienting the extension members 44, 46 with respect to the walls 28, 30. As should also be clear to one of ordinary skill in the art, the structure of the divider 26 is highly advantageous since the two walls 28, 30 are identical in structure as are the extension members 44, 46. Thus, the number of different pieces which must be manufactured and warehoused is reduced.

Figure 3:
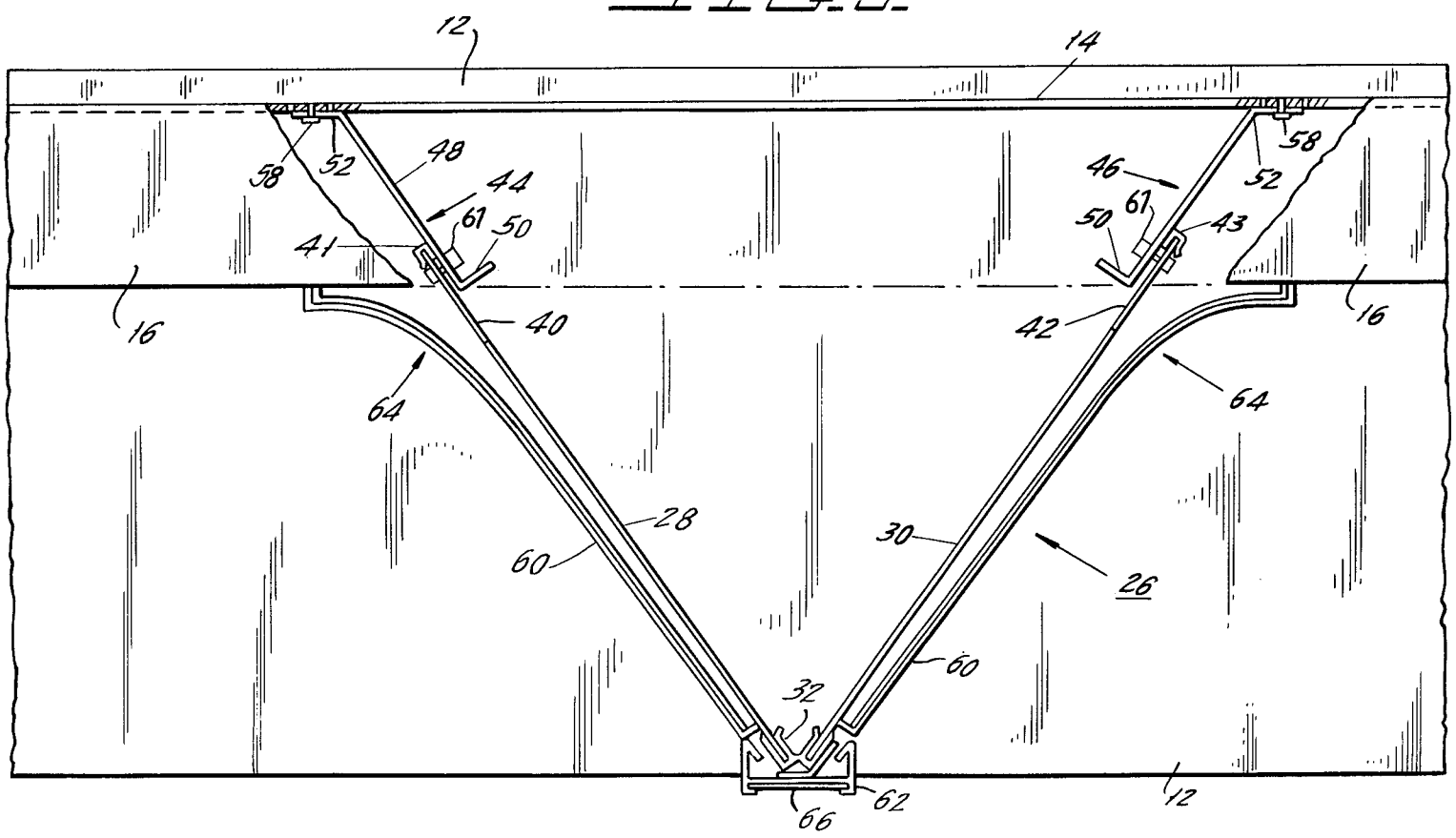
FIG. 3 is a top view of the central divider of FIG. 1.
Figure 5:
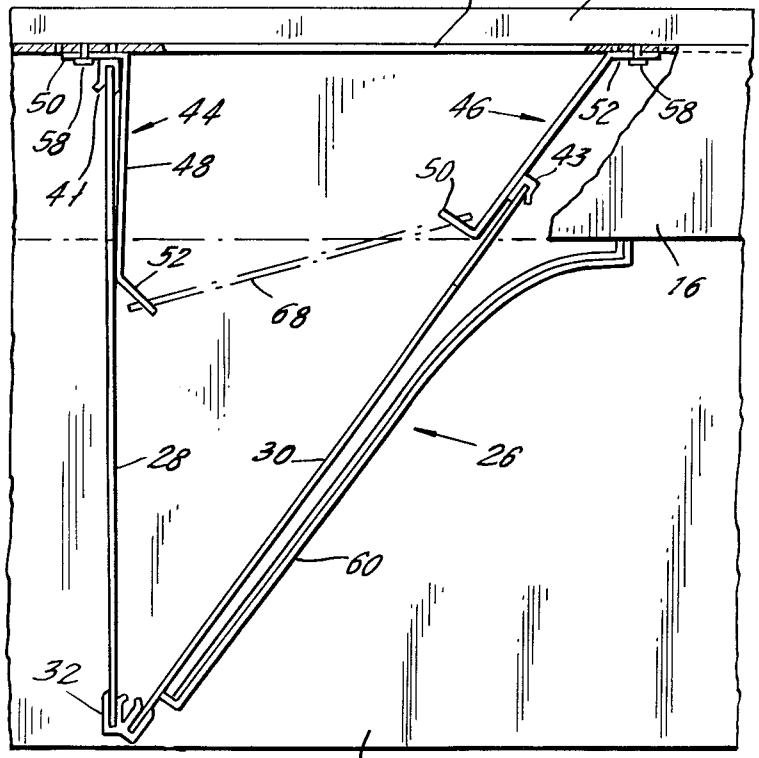
FIG. 5 is a top view partially broken away of the left-hand divider of FIG. 1.
Figure 4:
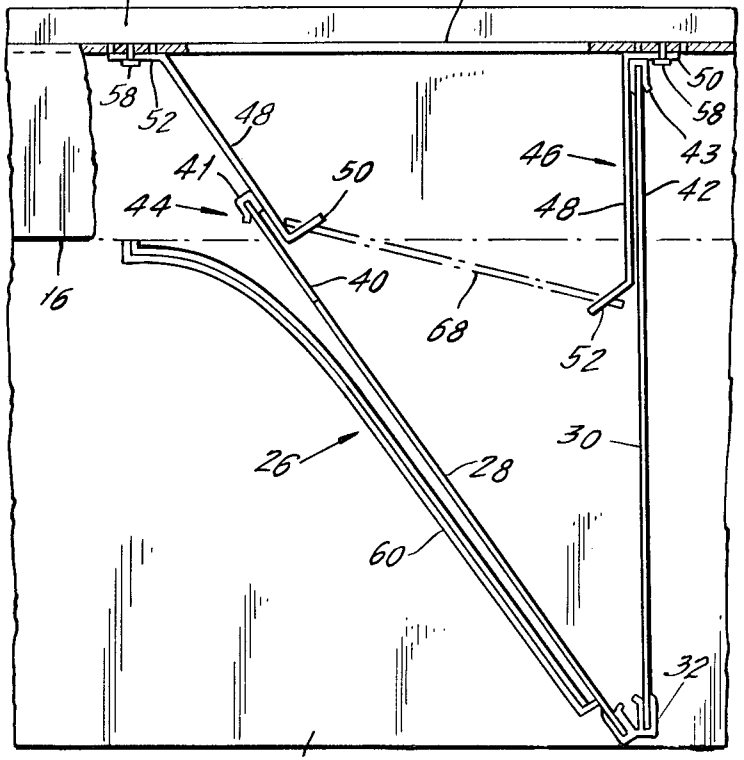
FIG. 4 is a top view of the right end divider of FIG. 1.

The manner in which the divider 26 can be used as a left end divider, a right end divider and a center divider can best be understood with reference to FIGS. 3–5. The manner in which the divider is used as a central divider is illustrated in FIG. 3. When used in this manner, the extension members 44, 46 are connected to their respective walls 28, 30 in a manner in which they effectively increase the width of the walls. In this orientation, the members 44, 46 only partially overlap their respective walls 28, 30 and the oblique angle sections 52 define mounting sections through which the divider 26 is mounted to the rear wall 14 by screws 58 or other appropriate connectors.

The manner in which the divider 26 may be used as a right end divider is illustrated in FIG. 4. In this arrangement, the extension member 44 is connected to the outer wall 28 and the rear wall 14 in the identical manner to that illustrated in FIG. 3. The orientation of the extension member 46 is, however, reversed such that the right angle section 50 is adjacent the rear wall 14 and such that the extension section 48 is substantially entirely overlapped by the wall 30. If desired, a support bar 68 can interconnect the right angle section of extension member 44 and the oblique angle section 52 of extension member 46 as shown. This will provide additional rigidity to the right-hand divider. A left-hand divider can similarly be formed by reversing the orientation of the extension members 44, 46 as illustrated in FIG. 5.

As best shown in FIGS. 1 and 3, the display preferably includes subsidiary headers 60 which are connected (by appropriate means 61 in FIG. 1) to respective divider walls 28, 30 and which are curved at 64 to give the apearance of merging into the principal headers 16. This is extremely important since the interaction of the principal header 16 and the subsidiary headers 60 provide the appearance of a continuous header with the result that the display 10 appears to be a custom-made display irrespective of the actual position of the dividers 26 along the rear wall 14. The front headers 62 further enhance this continuity. Slots are provided in the subsidiary headers 60 to provide product information (e.g., a class of goods or a particular brand) or to provide a design which is compatible with a design placed in the principal header 16. In the presently preferred embodiment, a mylar reflective sheet 66 is received in a slotted portion of header 62 for decorative purposes.

The present invention may be embodied in other specific forms without departing from the spirit or essential attributes thereof and, accordingly, reference should be made to the appended claims, rather than to the foregoing specification as indicating the scope of the invention.

What is claimed is:

1. A kit for making a multi-bay display, said kit including:

(A) a continuous rear wall;

(B) a plurality of bay dividers, each said bay divider including:

(1) first and second panels hingedly connected to one another, each said panel having a main surface which is generally rectangular in shape and which has a height and a width;

(2) at least one extension member;

(3) means for coupling each said extension member to a respective said panel in a manner which permits the effective width of the panel to which said extension member is coupled to be adjusted; and (C) means for attaching said bay dividers to said rear wall in such a manner that each bay divider forms a generally triangular shape with said rear wall to form a multi-bay display.

2. The kit of claim 1, wherein said one or more extension members includes first and second extension members and wherein said coupling means is adapted to couple said first and second extension members to said first and second panels, respectively.

3. The kit of claim 2, wherein said first and second extension members are identical to one another.

4. The kit of claim 3, wherein said first and second extension members each comprise a planar main section, a first end section connected to one end of said main section and which extends at a right angle to said main section and a second end section connected to a second end of said main section and which extends at an oblique angle to said main section, said first and second end sections extending on opposite sides of the plane defined by said main section.

5. The kit of claim 4, wherein said rear wall and said panels are formed of aperture board.

6. The kit of claim 5, wherein said coupling means and said attaching means each include nuts and bolts.

7. The kit of claim 1, wherein each of said extension members are identical to one another.

8. The kit of claim 7, wherein each said extension section comprises a planar main section, a first end section connected to one end of said main section and which extends at a right angle to said main section and a second end section connected to a second end of said main section and which extends at an oblique angle to said main section, said first and second end sections respectively extending on opposite sides of the plane defined by said main section.

9. The kit of claim 1, wherein said rear wall has a header extending the entire width thereof and wherein said kit further comprises:

subsidiary headers which may be attached to respective panels of said bay dividers, each said subsidiary headers being curved in such a manner that when it is attached to a said panel in the area of said principal header, it appears to merge into said principal header; and means for connecting said subsidiary headers to a respective panel.

10. The kit of claim 9, further including at least one front header and means for attaching each said front header to an apex of a respective said bay divider.

11. The kit of claim 1, wherein each panel of each said bay divider is identical to the remaining said panels.

12. The kit of claim 7, wherein each panel of each said bay divider is identical to the remaining said panels.

* * * * *